US007568371B2

(12) United States Patent
Polen et al.

(10) Patent No.: US 7,568,371 B2
(45) Date of Patent: Aug. 4, 2009

(54) STRETCH-FORMING MACHINE AND METHOD

(75) Inventors: Larry Alexander Polen, Matthews, NC (US); Jonathan Todd Harkey, Mt. Pleasant, NC (US)

(73) Assignee: Cyril Bath Company, Monroe, NC (US)

( * ) Notice: Subject to any disclaimer, the term of this patent is extended or adjusted under 35 U.S.C. 154(b) by 14 days.

(21) Appl. No.: 11/562,816

(22) Filed: Nov. 22, 2006

(65) Prior Publication Data

US 2007/0163323 A1 Jul. 19, 2007

Related U.S. Application Data

(60) Provisional application No. 60/766,405, filed on Jan. 17, 2006.

(51) Int. Cl.
*B21D 11/02* (2006.01)

(52) U.S. Cl. ..... 72/302; 72/296

(58) Field of Classification Search ..... 72/296, 72/297, 302, 392

See application file for complete search history.

(56) References Cited

U.S. PATENT DOCUMENTS 3,299,688 A 1/1967 Gray
4,706,486 A * 11/1987 Kan ..... 72/302
4,747,292 A * 5/1988 Chorneau ..... 72/297
5,910,183 A * 6/1999 Ford et al. ..... 72/21.5
6,018,970 A 2/2000 Ford et al.

* cited by examiner

*Primary Examiner*—Dana Ross
*Assistant Examiner*—Debra M Sullivan
(74) *Attorney, Agent, or Firm*—Adams Intellectual Property Law, P.A.

(57) ABSTRACT

A stretch-forming machine of the type wherein a pair of opposed curving jaw assemblies grip opposite end edge portions of a metal sheet for initially stretching the metal sheet into a yield state and forming the metal sheet into a predetermined curved configuration. Each jaw assembly includes a jaw having an array of adjacent grippers or groups of grippers moveable relative to each other to define a part of the curve of the jaw and adapted to extend along one side edge of the metal sheet from adjacent a first corner to adjacent a second corner of the sheet, a moveable yoke connected to the jaw, a pivot connecting the yoke to a beam way, and at least one actuator connected to the yoke for pivoting the jaw about the pivot to urge the grippers at opposing ends of the gripper array away from the pivot while the grippers adjacent a centerline of the gripper array remain approximately stationary. The pivot and the actuator cooperate to stretch the outer corners of the metal sheet while substantially minimizing elongation along the centerline of the metal sheet.

17 Claims, 10 Drawing Sheets

STRETCH-FORMING MACHINE AND METHOD

CROSS-REFERENCE TO RELATED APPLICATIONS

This application claims the benefit of Provisional Application No. 60/766,405, Filed Jan. 17, 2006.

TECHNICAL FIELD AND BACKGROUND OF THE INVENTION

This invention relates to a metal sheet stretch-forming machine of the type having two opposed clamping jaws. While the term "stretch-forming" is used in this application, the invention is intended to have application to any type of metal-forming machine wherein jaws have a number of adjacent grippers which are collectively curvable so as to closely conform to the shape to be imparted to the metal sheet.

The clamping jaws are formed of a series of hinged grippers that move relative to each other in such a manner as to collectively form concave, convex, or lazy-S curves. These opposed jaws are used to grip opposing ends of a metal sheet while the sheet is stretched into its yield state. While in that state, the metal sheet is formed over a die. Each of the grippers is actuated against a mechanical or electrical stop by hydraulic cylinders so that the gripped sheet can be loaded flat, then caused to assume a contour roughly in the shape of the curved surface of the die. Thus, the use of curved jaws in a stretch-forming machine saves material that would otherwise be wasted by the transition from a straight jaw's opening to the surfaces of a curved die. Each of the grippers (or groups of grippers) is controlled by a hydraulic cylinder, and the collective, accumulated motion of the hydraulic cylinders of adjacent grippers defines the curve of the jaw. The stretch-forming machine may be computer or manually controlled, or a combination of computer and manual controls may be used.

Existing stretch-forming machines, including those of applicant, such as disclosed in U.S. Pat. Nos. 5,910,183 and 6,018,970, have the capability of forming longitudinal compound curved shapes such as those used in aircraft fuselage and wing sections. Because of the compound curvature, the longitudinal centerline of the stretch-formed part is elongated before and to a greater extent than the outer edges. Thus, any further stretching of the outer edge portions of the part in an effort to achieve similar elongation of the outer edge portions results in possibly overstretching the longitudinal center portion of the part, thus increasing the possibility of material failure.

Conventional methods of achieving the required elongation at the outer edges require that the part be subjected to an intermediate annealing process once proper elongation of the center portion of the part has been achieved. This method requires removing the part from the stretch-forming machine, transporting the part to an annealing furnace, annealing the part, and returning the part to and re-installing the part on the stretch-forming machine. A second stretch-forming process is then carried out. While the edge portions may then be stretched to the proper amount, the center portion is simultaneously stretched some additional amount beyond its optimum stretch, resulting in a part with different degrees of stretch in different areas.

Ideally, stretch-forming compound curved parts should be accomplished so as to impart optimum stretch to the edge portions of the part without significantly altering the optimum stretch in the center areas of the part. Accordingly, a stretch-forming machine and process is disclosed in this application that accomplishes this result.

SUMMARY OF THE INVENTION

Therefore, it is an object of the invention to provide a stretch-forming machine that imparts the proper amount of stretch to a compound curved part during a single operation.

It is another object of the invention to provide a stretch-forming machine that applies optimum stretch to the edge portions of a stretch-formed part and the center portions of a stretch-formed part.

It is another object of the invention to provide a stretch-forming machine that imparts optimum stretch to the edge portions of a stretch-formed part without altering the optimum stretch in the center areas of the part.

It is another object of the invention to provide a method of stretch-forming metal parts that applies the proper amount of stretch to a compound curved part during a single operation.

It is another object of the invention to provide a method of stretch-forming metal parts that applies optimum stretch to the edge portions of a stretch-formed part and the center portions of a stretch-formed part.

It is another object of the invention to provide a method of stretch-forming metal parts that imparts optimum stretch to the edge portions of a stretch-formed part without disturbing the optimum stretch in the center areas of the part.

These and other objects of the present invention are achieved in the preferred embodiments disclosed below by providing a stretch-forming machine of the type wherein a pair of opposed curving jaw assemblies grip opposite end edge portions of a metal sheet for initially stretching the metal sheet into a yield state and forming the metal sheet into a predetermined curved configuration. Each jaw assembly includes a jaw having an array of adjacent grippers moveable relative to each other to define a part of the curve of the jaw and adapted to extend along one side edge of the metal sheet from adjacent a first corner to adjacent a second corner of the sheet; a moveable yoke connected to the jaw; a pivot connecting the yoke to a beam way; and at least one actuator connected to the yoke for pivoting the jaw about the pivot to urge the grippers at opposing ends of the gripper array away from the pivot while the grippers adjacent a centerline of the gripper array remain approximately stationary. The pivot and the actuator cooperate to stretch the outer corners of the metal sheet while substantially minimizing elongation along the centerline of the metal sheet.

According to another preferred embodiment of the invention, the stretch-forming machine includes a moveable die upon which the metal sheet is formed into a predetermined curved configuration.

According to another preferred embodiment of the invention, the stretch-forming machine includes a bulldozer assembly moveable relative to the die for forming the metal sheet.

According to another preferred embodiment of the invention, the stretch-forming machine includes respective hydraulic cylinders adapted to move the grippers or groups of the grippers relative to each other to form the opposite ends of the metal sheet into predetermined curved configurations.

According to another preferred embodiment of the invention, the stretch-forming machine includes at least one respective hydraulic cylinder carried by each yoke and adapted to urge each yoke along the beam way.

According to another preferred embodiment of the invention, the stretch-forming machine includes at least one respective hydraulic cylinder carried by each yoke and adapted to move each jaw relative to each respective yoke.

According to another preferred embodiment of the invention, a stretch-forming machine includes a pair of opposed curving jaw assemblies for gripping opposite end edge portions of a metal sheet, and each jaw assembly includes a jaw having an array of adjacent grippers moveable relative to each other to define a curve in which a center gripper is positioned at an apex of the array intermediate two opposed end grippers of the array, a moveable yoke connected to the jaw, a pivot connecting the yoke to a beam way, and at least one actuator connected to the yoke for pivoting the jaw about the pivot. The axis of the pivot is defined as the intersection of a line tangent to the curve of the array at a point located within the center gripper and a plane defined by the center gripper and the two end grippers. The pivot and the actuator cooperate to stretch the outer corners of the metal sheet while substantially minimizing elongation along the centerline of the metal sheet.

According to another preferred embodiment of the invention, a method of stretch-forming a metal sheet includes providing a stretch-forming machine of the type wherein a pair of opposed curving jaw assemblies grip opposite end edge portions of a metal sheet to be formed into a predetermined curved configuration, and each jaw assembly includes a jaw having an array of adjacent grippers moveable relative to each other to define a part of the curve of the jaw and adapted to extend along one side edge of the metal sheet from adjacent a first corner to adjacent a second corner of the sheet, a moveable yoke connected to the jaw, a pivot connecting the yoke to a beam way, and at least one actuator connected to the yoke for pivoting the jaw about the pivot. The method further includes stretching the metal sheet to a yield state by retracting the jaws rearwardly away from each other, forming the metal sheet into a desired curvature over a die, and pivoting the jaws about the pivots using the at least one actuator to urge the grippers at opposing ends of the gripper array away from the pivot while the grippers adjacent a centerline of the gripper array remain approximately stationary. The pivot and the actuator cooperate to stretch the outer edges of the metal sheet while substantially minimizing elongation along the centerline of the metal sheet.

According to another preferred embodiment of the invention, the method of stretch-forming a metal sheet includes the step of forming the metal sheet over a bulldozer assembly, the bulldozer assembly being moveable relative to the die.

According to another preferred embodiment of the invention, the method of stretch-forming a metal sheet includes the step of utilizing computer-controlled servo-feedback technology to define and control the shape of the metal sheet to be formed.

According to another preferred embodiment of the invention, the method of stretch-forming a metal sheet includes the step of stretching the metal sheet to a yield state by urging the yokes away from each other along the beam way by at least one respective hydraulic cylinder carried by each yoke.

According to another preferred embodiment of the invention, the method of stretch-forming a metal sheet includes the step of stretching the metal sheet to a yield state by retracting the jaws within their respective yokes by at least one respective hydraulic cylinder carried by each yoke.

According to another preferred embodiment of the invention, the method of stretch-forming a metal sheet includes the step of forming the opposite ends of the metal sheet into predetermined curved configurations using respective hydraulic cylinders carried by each gripper and adapted to move the grippers relative to each other.

BRIEF DESCRIPTION OF THE DRAWINGS

The invention may be best understood by reference to the following description taken in conjunction with the accompanying drawing figures in which.

DESCRIPTION OF THE PREFERRED EMBODIMENT AND BEST MODE

Figure 1:
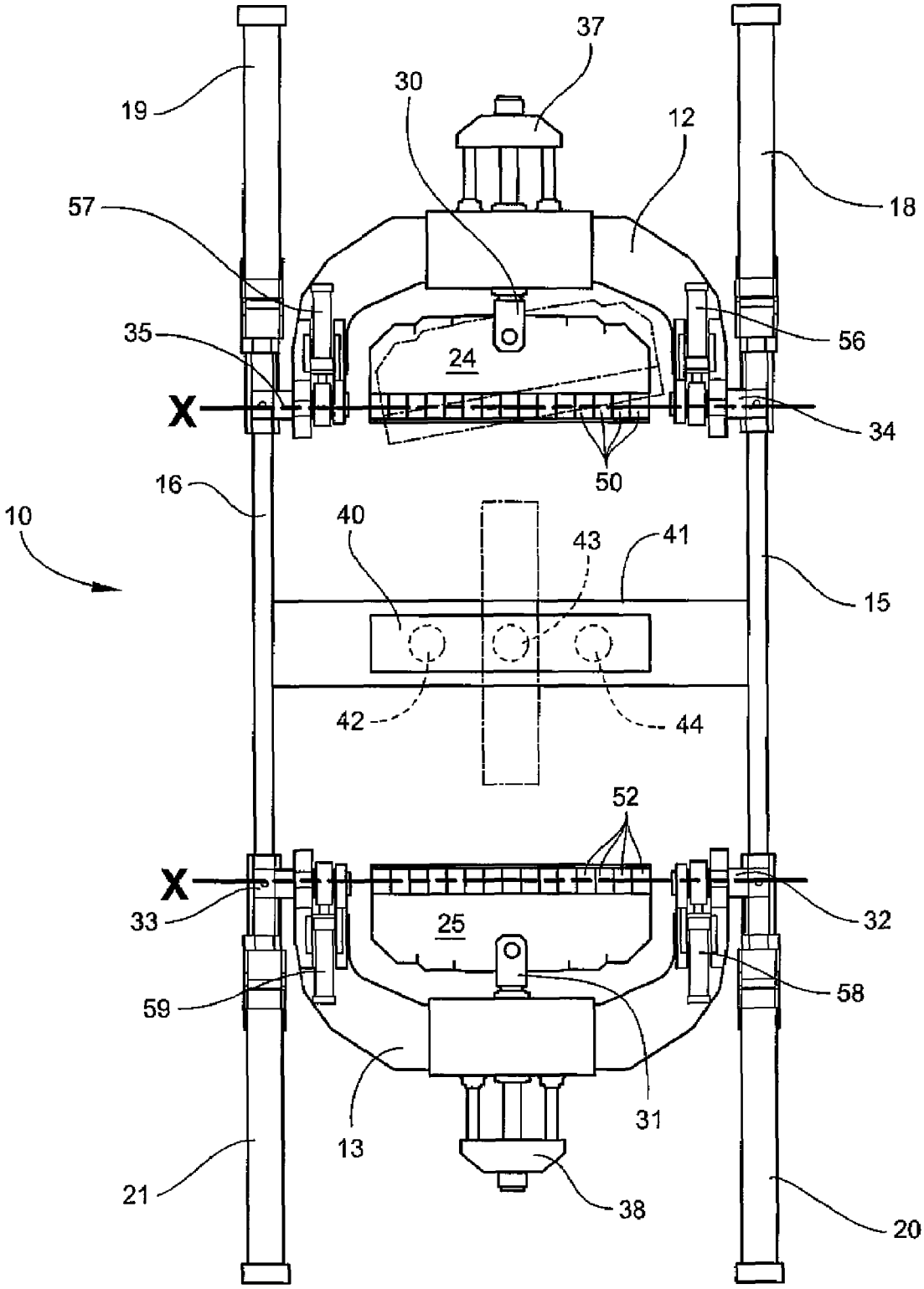
FIG. 1 is a simplified top plan view of a curving jaw stretch-forming machine of the type on which the invention of the application is utilized.
Figure 2:
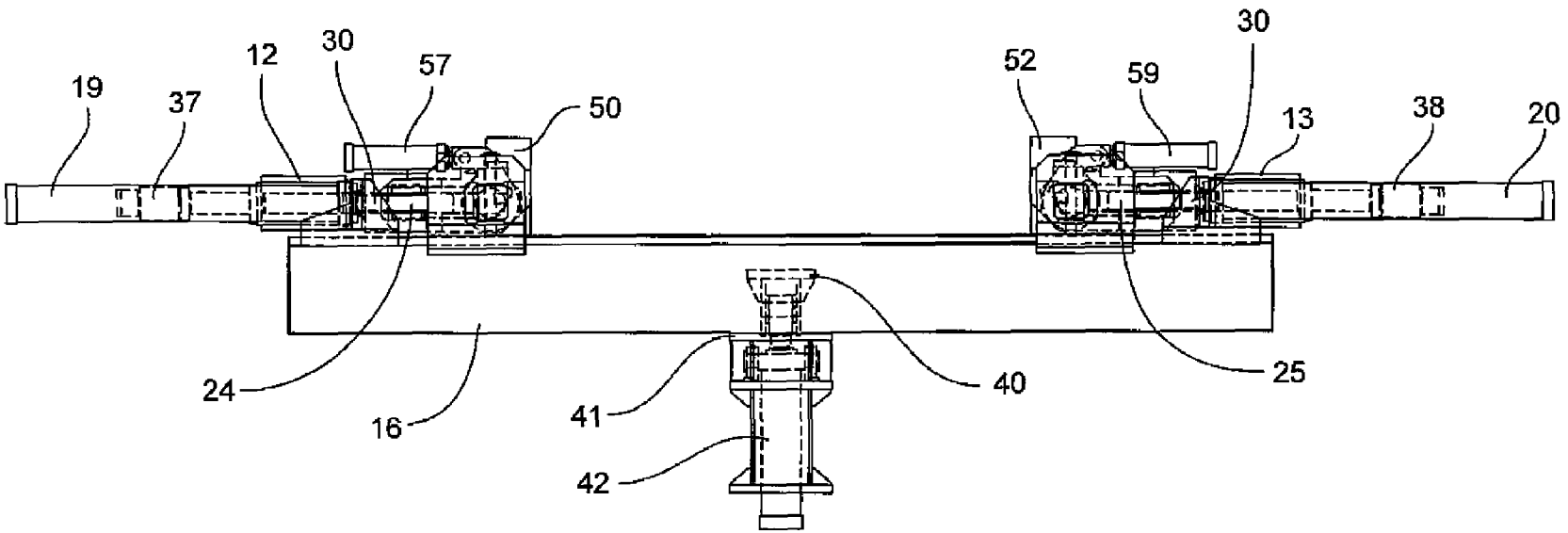
FIG. 2 is a side elevation of the stretch-forming machine shown in FIG. 1.

Referring now specifically to the drawings, a stretch-forming machine 10 according to an embodiment of the invention is shown in simplified form in FIGS. 1 and 2. As generally shown, the stretch-forming machine 10 includes a pair of yokes 12, 13 riding on respective beam ways 15, 16 and actuated by carriage cylinders 18, 19 and 20, 21, respectively. Yokes 12, 13 carry respective jaws 24, 25, each of which are mounted for movement on several axes. Jaw angulation is provided by asymmetric movement of the carriage cylinders 18, 19 (jaw 24) and carriage cylinders 20, 21 (jaw 25).

Oscillation of jaws 24, 25 is provided by respective pairs of oscillation cylinders, not shown, that are carried on the jaws 24, 25. Jaw rotation is provided by rotation cylinder assemblies through rotation rods 30, 31 that interconnect the yokes 12, 13 and respective jaws 24, 25, and permit the jaws 24, 25 to rotate about a longitudinal horizontal axis relative to the yokes 12, 13 during sheet loading and forming. Tension is placed on the metal sheet by retracting the jaws 24, 25 in the yokes 12, 13 by means of respective tension cylinder assemblies 37, 38. Pivot assemblies 32, 33, 34, 35 permit the yokes 12, 13 and jaws 24, 25 to pivot about a lateral, horizontal axis.

A centrally-positioned die table 40 is supported by a die table support beam 41 and is mounted on a guide post 43 for vertical movement. This vertical movement is provided by the action of die table cylinders 42, 44. Stretch-forming of a metal sheet occurs as a die, not shown, is moved vertically upwardly by the die table cylinders 42, 44, and the tension cylinder assemblies 37, 38 hold the metal sheet in a tensioned condition. Vertical movement of the die table cylinders 42, 44 cause the yokes 12, 13 to pivot about the pivot assemblies 32, 33, 34, 35.

Asymmetric movement of the die table cylinders 42, 44, and consequent asymmetric movement of the die table 40 is accommodated by rotation of the jaws 24, 25 about the rotation cylinder assemblies through rotation rods 30, 31. A bulldozer assembly, not shown, may be mounted above the die table 40 for being moved vertically into and out of forming contact with a forming die on the die table 40 to form shapes, such as reverse curves, which would otherwise require a separate forming operation as, for example, drop hammer forming.

The jaws 24, 25 include generally laterally-extending gripper arrays 50, 52, respectively, into which opposing edge portions of the sheet to be formed are loaded. These gripper arrays 50, 52 are pivotally mounted relative to each other in such a manner as to permit motion of each gripper of the gripper arrays 50, 52 relative to adjacent grippers, and, as well, an accumulation of motion which results in a upwardly or downwardly-extending curved shape to the gripper arrays 50, 52.

Ordinarily, the gripper arrays 50, 52 are positioned in a straight configuration for sheet loading. Respective pairs of swing cylinders 56, 57 and 58, 59 swing the jaws 24, 25 and yokes 12, 13 up and down as required during the sheet-forming operation. Prior art devices utilize mechanical stops and other devices to limit movement of grippers and thus define the degree and shape of the curve desired. Applicant's prior art stretch-forming machines also use computer-controlled servo-feedback technology to define and control the shape to be formed.

Figure 3:
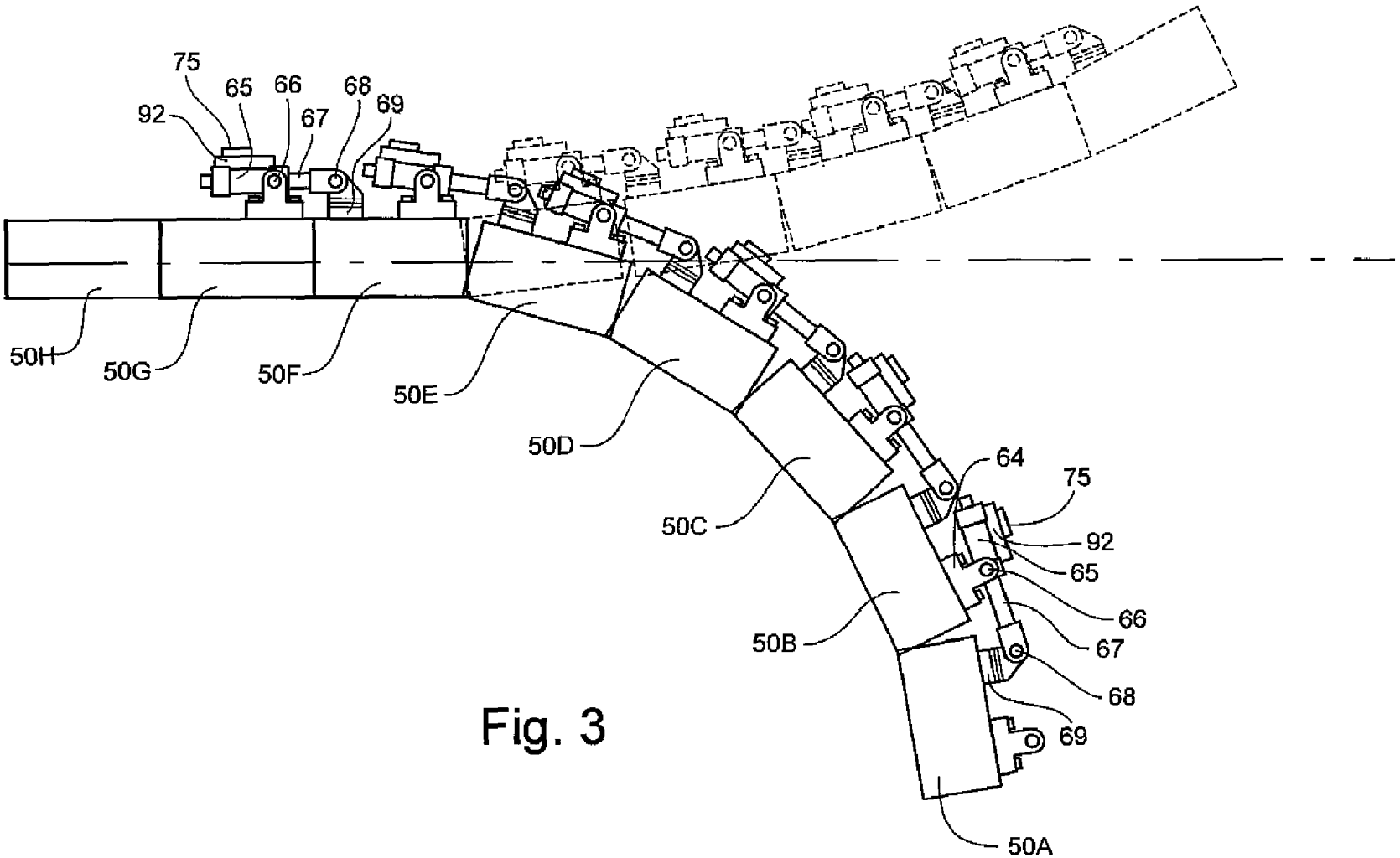
FIG. 3 is a simplified fragmentary end view of one side of a curving jaw showing the range of up and down motion of the array of grippers carried on the jaw.

In accordance with a preferred embodiment of the invention shown in FIG. 3, grippers 50A, 50H of the gripper array 50, illustrative of the entire gripper arrays 50, 52, are mounted for pivotal movement relative to each other. For example, gripper 50B carries a pillow block 64 to which a hydraulic cylinder 65 is pivotally mounted by a cylinder trunnion 66. The piston rod 67 of the hydraulic cylinder 65 extends over to the adjacent gripper 50A and is pivotally connected to the gripper 50B by a clevis pin 68 pivotally mounted on a base 69. Thus, pivotal movement of the grippers 50A-50H relative to each other occurs by extension and retraction of the piston rods 67 of the hydraulic cylinders 65 as hydraulic fluid is pumped under pressure to the hydraulic cylinders 65. It is also possible that the grippers of the gripper arrays 50, 52 may be arranged in groups of two or more, rather than being individually moveable.

Figure 4:
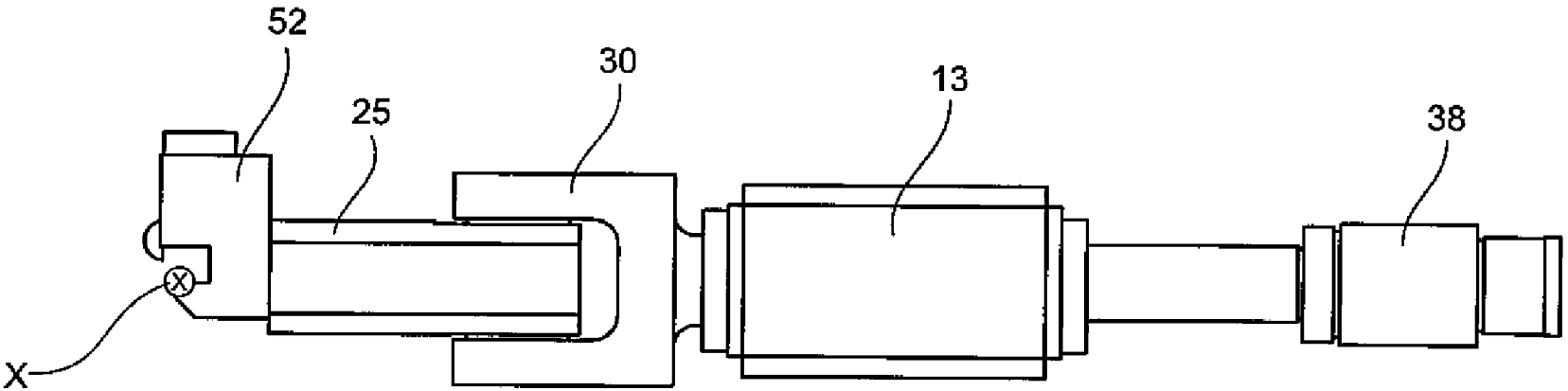
FIG. 4 is a side elevation of a jaw of the stretch-forming machine.

An overall side elevation of a jaw of the stretch-forming machine is shown in FIG. 4.

In contrast to conventional stretch-forming procedures, the preferred embodiment of the invention utilizes a progressive reverse pivot in the grippers of the gripper arrays 50, 52 that increases elongation/stress on the outer edges of the stretch-formed part while minimizing elongation along the centerline area of the part. This is accomplished, with reference to FIGS. 4-8, by positioning the front edge of the respective gripper arrays 50, 52 to the pivot location of the jaws 24, 25. Locating the pivot at this position minimizes additional elongation/stress to the longitudinal centerline areas of the part during further edge compensation forming.

Figure 5:
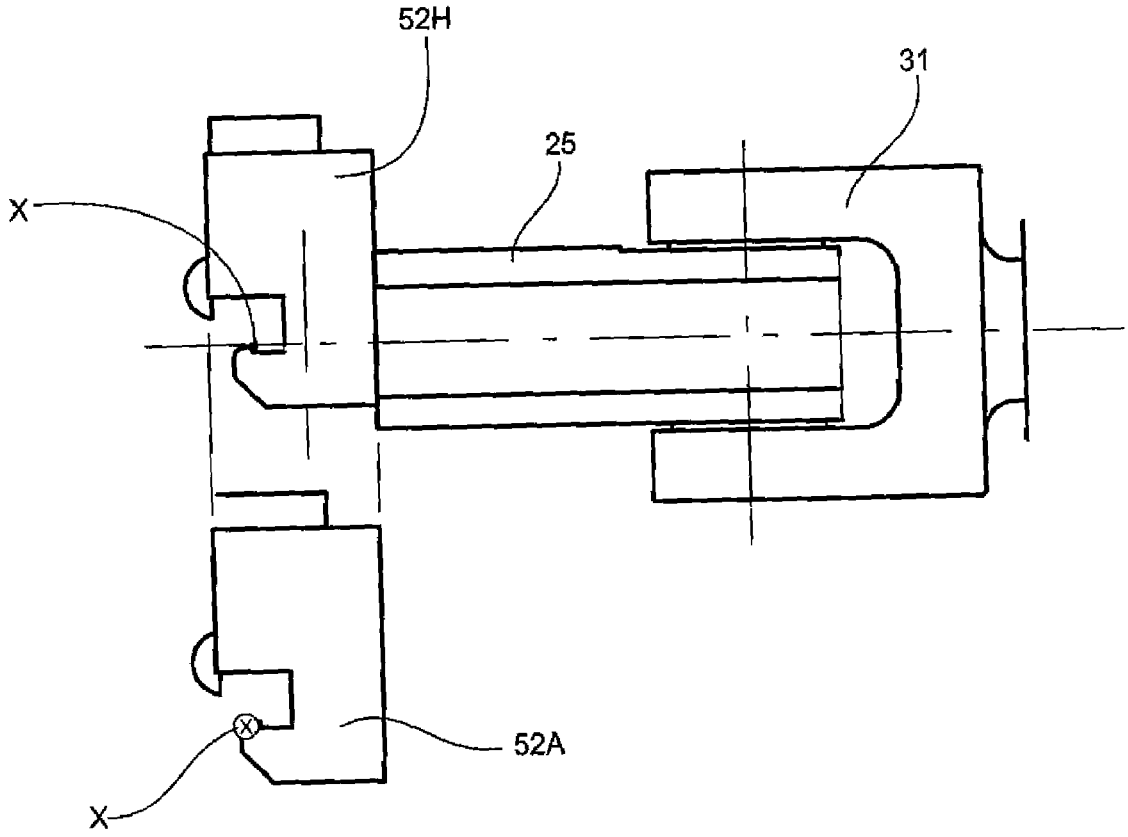
FIG. 5 is an enlarged, partial side elevation of the jaw shown in FIG. 4.
Figure 6:
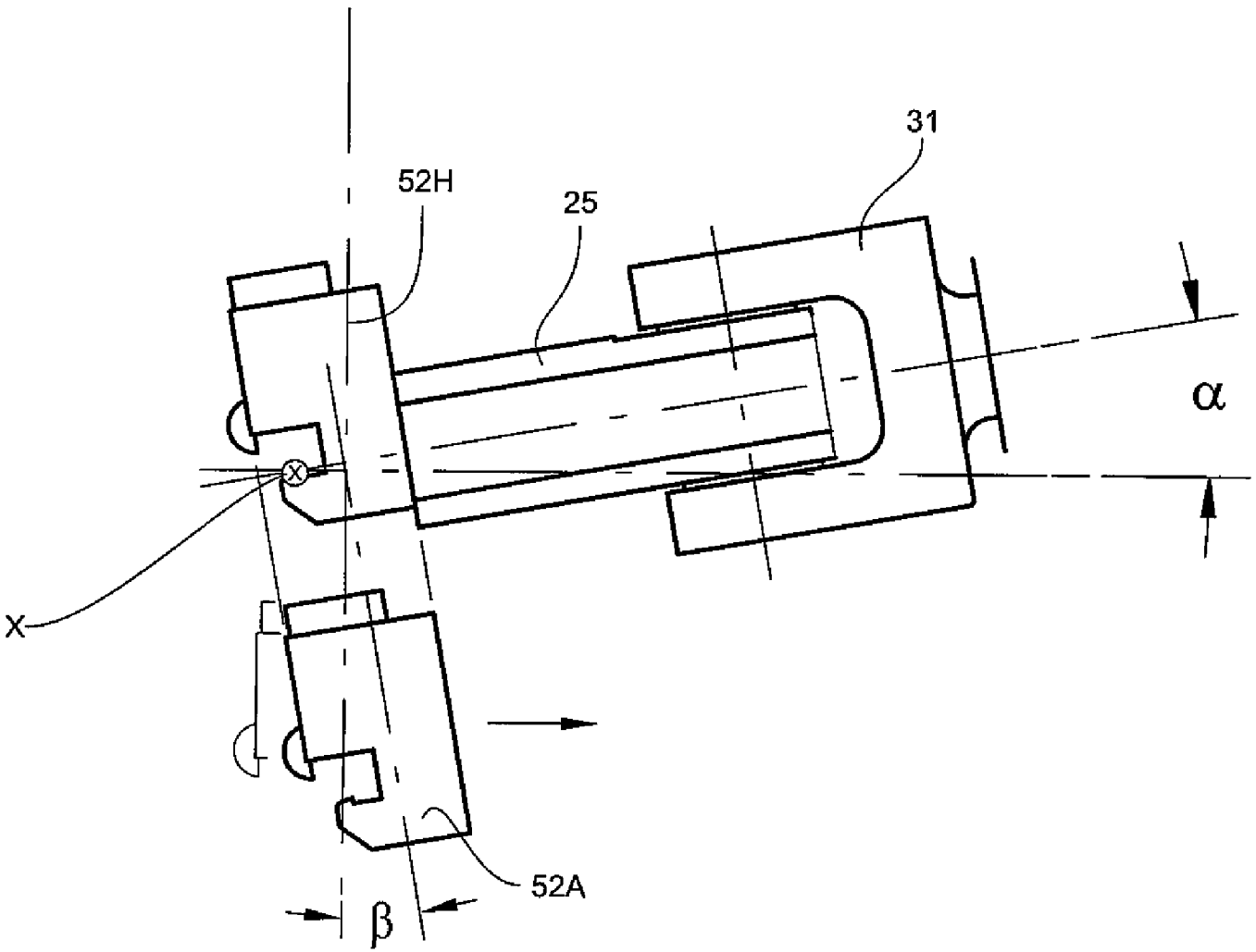
FIG. 6 is a view similar to FIG. 5 showing the optimum jaw location and pivot motion of the jaw shown in FIG. 5.

More specifically with reference to FIGS. 5 and 6, the jaw pivot location of jaw 24, also representative of jaw 25, is indicated at "X", and defining a laterally extending pivot axis. The two indicated grippers 52A and 52H of the gripper array 52, representing an edge and center gripper respectively, have a forwardly-positioned jaw pivot location that, as shown, permits the edge gripper 52A to pivot rearwardly while the gripper 52H remains in essentially the same location. As a result, the center area of the sheet being held by the center gripper 52H maintains a constant, ideal elongation while the edge gripper 52A is pivoted about the jaw pivot location X. By comparing FIGS. 5 and 6, it is shown that the center gripper 52H remains essentially stationary, while the edge gripper 52A has moved rearwardly a distance β in a stretching direction due to the pivotal motion, which is powered and controlled by the swing cylinders 58,59. The angle α represented in FIG. 6 is the angle by which additional stretch can be added to the edge areas of the part, while holding the center area of the part at an optimum elongation.

Figure 7:
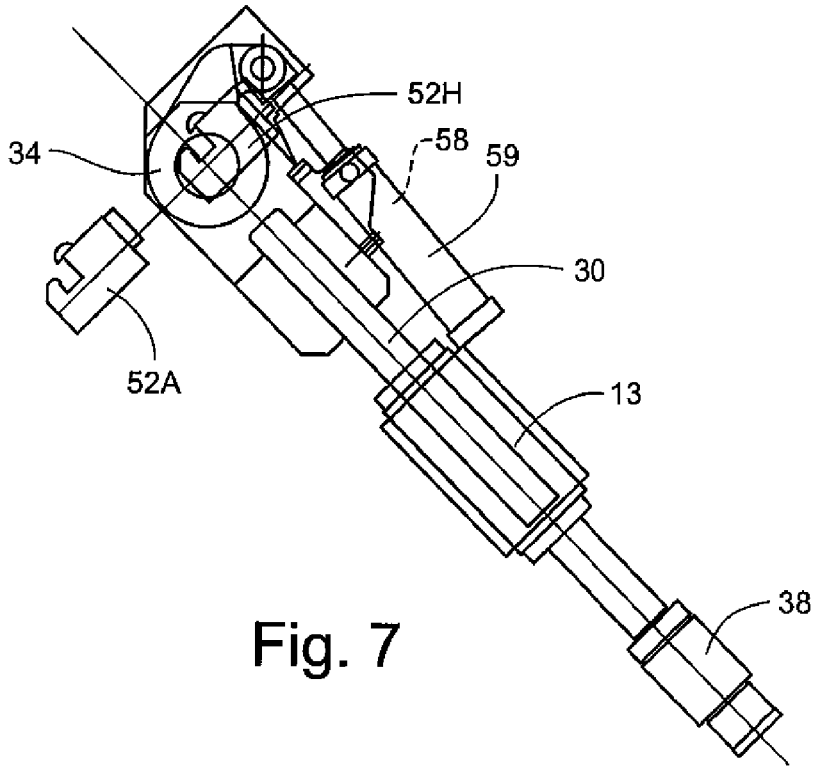
FIG. 7 is a side elevation view showing the location of the jaw at normal stretch.
Figure 8:
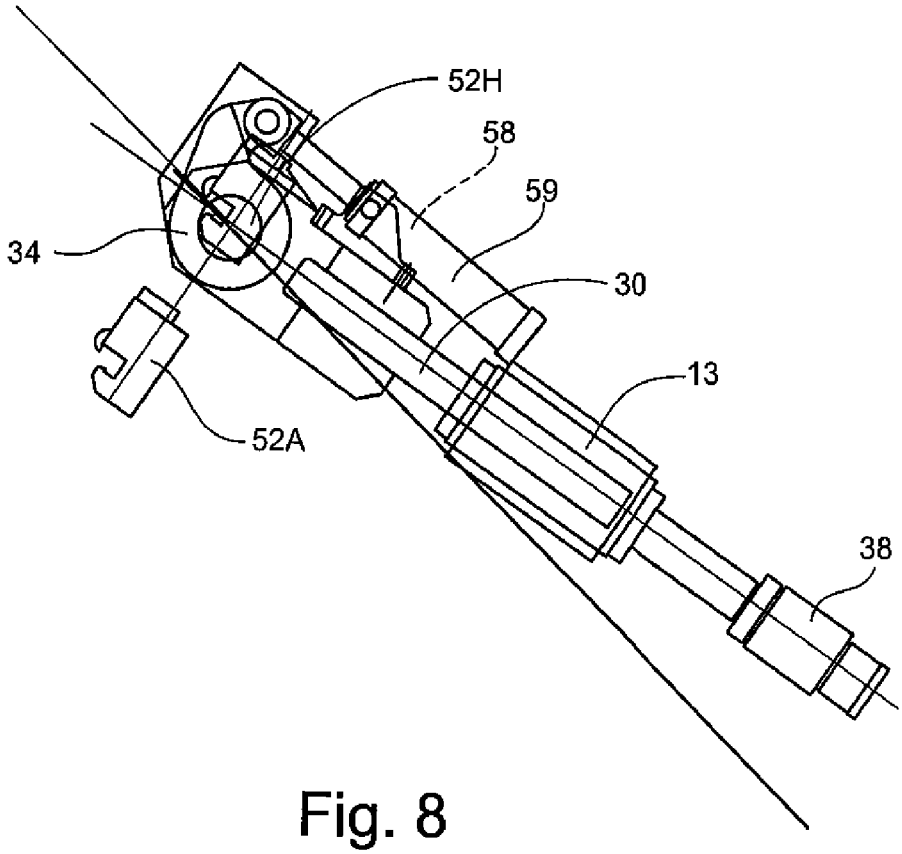
FIG. 8 is a pivot motion and side elevation view showing the location of the jaw at optimum edge areas stretch.

FIGS. 7 and 8 provide further views showing pivotal movement of a representative jaw and yoke assembly at optimum center stretch position, FIG. 7, and optimum edges stretch position, FIG. 8.

Figure 9:
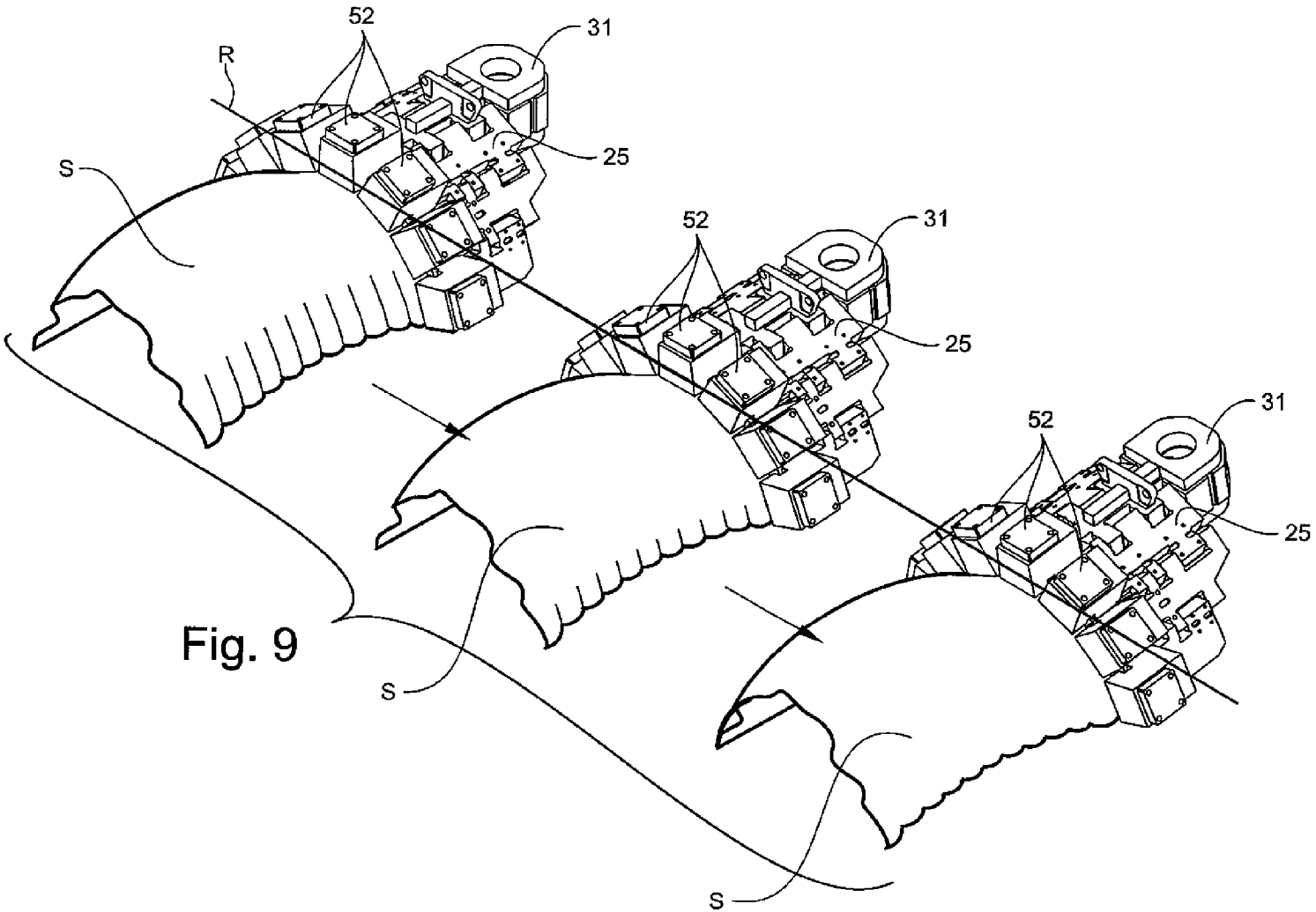
FIG. 9 is a partial sequential perspective view, with parts broken away and exaggerated edge wrinkling, showing movement of the outboard jaws applying additional stretch to the edge portions.

This function is also shown sequentially in FIG. 9, where the part, for example, sheet "S", is first stretched to a point where the center area of the part has optimum elongation, but where the edge areas still retain wrinkles, greatly exaggerated for clarity. By further rotating the jaw, the edges of the sheet "S" are progressively further elongated, while maintaining the optimum elongation of the center area. As shown in FIG. 9 and in reference to reference line "R", edge grippers further stretch sheet "S" in the stretching direction.

Figure 10:
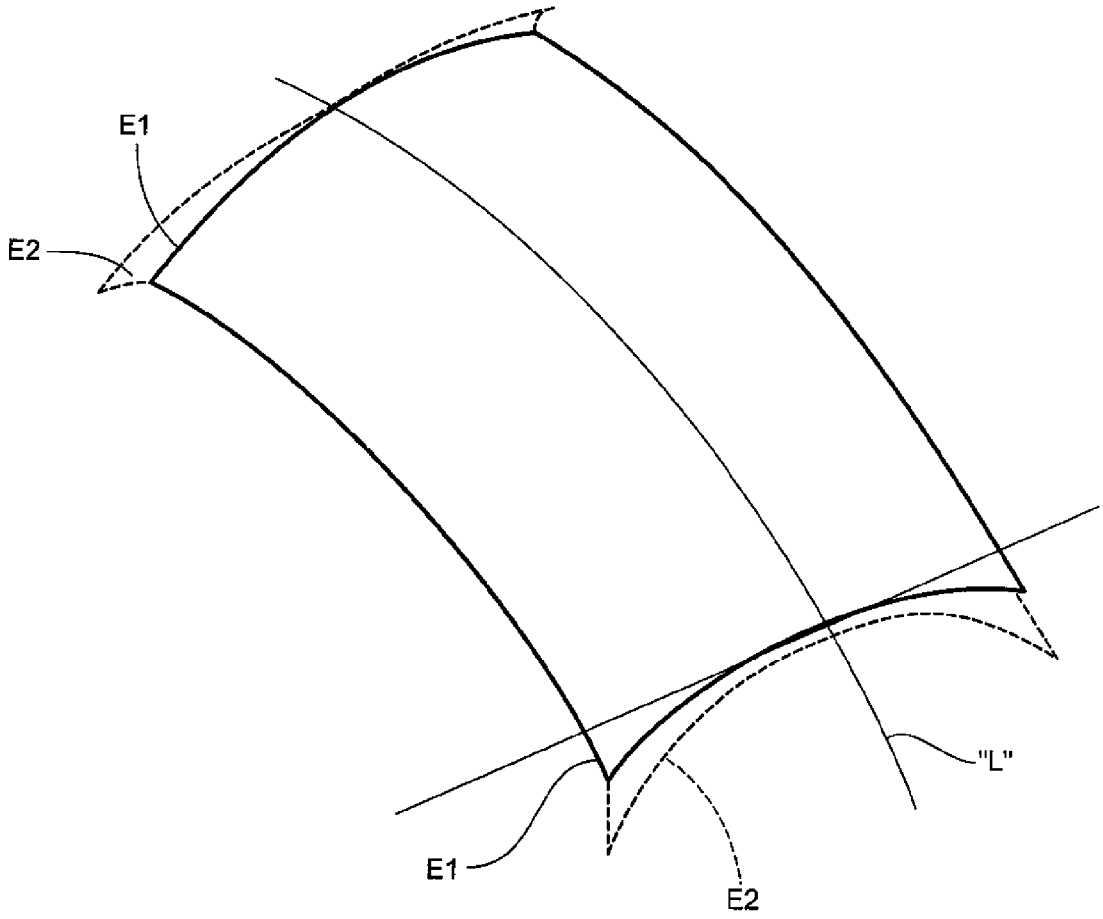
FIG. 10 is a schematic of a stretch-formed part illustrating edge stretch-forming compensation.

As is shown in FIG. 10, stretch in the longitudinal direction "L" is essentially the same from side to side in the center areas of sheet, for example, 7-8 percent. Stretch in the edge area E1 may be half or less during a single prior art stretch-forming operation, for example, 3-4 percent. Using the disclosed stretch-forming machine 10 and related process, a single stretch-forming operation results in a stretch in the edge area E2 that is similar to that in the center area of the sheet, for example, 7-8 percent. While some minimal additional elongation to the center area may occur during the edge stretching step, the end result is a stretch-formed sheet where the stretch in both the center and edge areas are sufficiently equivalent to permit utilization of the sheet without an intermediate annealing process and its attendant additional expense and time.

Figure 11:
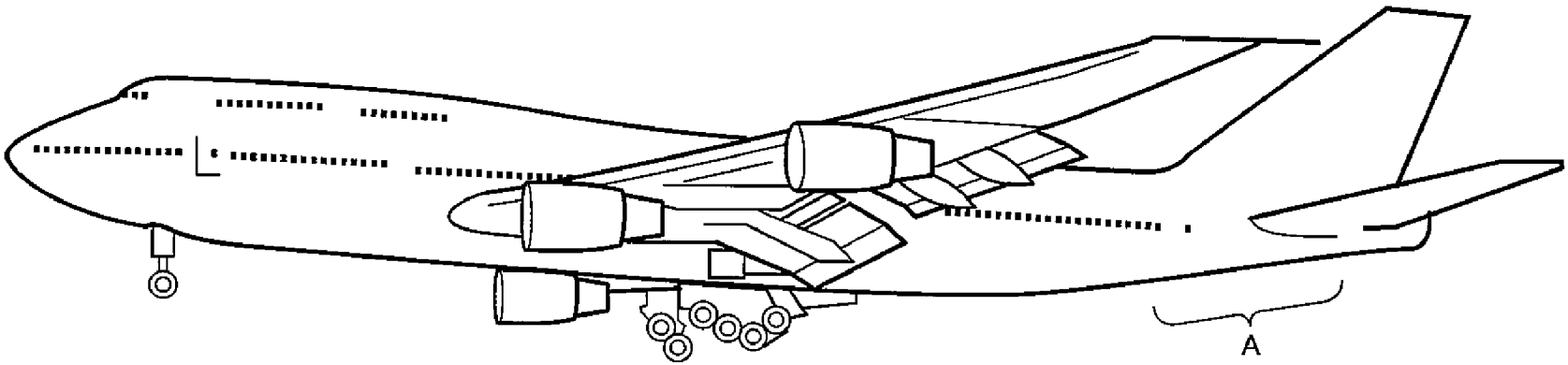
FIG. 11 is a perspective view of an aircraft showing an exemplary stretch-formed part location.

Stretch formation of parts in this manner has particular application in forming aircraft fuselage and control surface parts, where compound curves and relatively sharp part angles are present in an environment where optimum stretch-forming is highly desirable. FIG. 11 illustrates one area "A" of many areas of an aircraft where the type of stretch-forming described above is useful.

An improved stretch-forming machine and method is described above. Various details of the invention may be changed without departing from the scope of the invention. Further, the foregoing description of the preferred embodiment of the invention and best mode for practicing the invention are provided for the purpose of illustration only and not for the purpose of limitation, the invention being defined by the claims.

What is claimed is:

1. In a stretch-forming machine of the type wherein a pair of opposed curving jaw assemblies grip opposite end edge portions of a metal sheet for initially stretching the metal sheet into a yield state, and forming the metal sheet into a predetermined curved configuration, the improvement wherein each jaw assembly comprises:

a) a jaw comprising an array of adjacent grippers moveable relative to each other to collectively define the curve of the jaw for gripping a respective one of the opposite end edge portions of the sheet from adjacent a first corner area to adjacent a second corner area of the sheet;

b) a moveable yoke connected to the jaw;

c) a pivot assembly connecting the yoke to a beam way for pivoting the jaw about a laterally extending pivot axis defined by a contact point between the metal sheet and at least one centrally-positioned gripper, the pivot assembly being aligned with the laterally extending pivot axis at the contact point within sheet-gripping openings defined by respective ones of the grippers, such that the centrally-positioned gripper pivots about the contact point of the pivot axis during pivotal movement of the centrally-positioned gripper thereby maintaining the contact point in about the same position during pivoting; and d) at least one actuator for pivoting the jaw about the pivot axis and urging grippers adjacent the centrally-positioned gripper in a stretching direction to further progressively stretch the first and second corner areas of the metal sheet while minimizing further elongation along a central area of the metal sheet proximate the centrally-disposed gripper.

2. The stretch-forming machine according to claim 1, further including a moveable die upon which the metal sheet is formed into a predetermined curved configuration.

3. The stretch-forming machine according to claim 2, further including a bulldozer assembly moveable relative to the die for forming the metal sheet.

4. The stretch-forming machine according to claim 1, further including respective hydraulic cylinders adapted to move the grippers or groups of the grippers relative to each other to form the opposite ends of the metal sheet into predetermined curved configurations.

5. The stretch-forming machine according to claim 1, further including at least one respective hydraulic cylinder carried by each yoke and adapted to urge each yoke along the beam way.

6. The stretch-forming machine according to claim 1, further including at least one respective hydraulic cylinder carried by each yoke and adapted to move each jaw relative to each respective yoke.

7. A stretch-forming machine comprising a pair of opposed curving jaw assemblies for gripping opposite end edge portions of a metal sheet, each jaw assembly including:

a) a jaw comprising an array of adjacent grippers moveable relative to each other to define a curve in which at least one centrally-positioned gripper is positioned at an apex of the array intermediate two opposed end grippers of the array;

b) a moveable yoke connected to the jaw;

c) a pivot assembly connecting the yoke to a beam way and defining a laterally-extending pivot axis defined as the intersection of:

i) a line tangent to the curve of the array at a contact point between the at least one centrally-positioned gripper and the metal sheet; and ii) a plane defined by the at least one centrally-positioned gripper and the two end grippers, the jaw being aligned with the laterally extending pivot axis at the contact point within sheet-gripping openings defined by respective ones of the grippers; and d) at least one actuator connected to the yoke for pivoting the jaw about the contact point of the pivot axis, thereby further stretching outer corners of the metal sheet in a stretching direction while substantially minimizing elongation along a centerline of the metal sheet.

8. The stretch-forming machine according to claim 7, further including a moveable die upon which the metal sheet is formed into a predetermined curved configuration.

9. The stretch-forming machine according to claim 8, further including a bulldozer assembly moveable relative to the die for forming the metal sheet.

10. The stretch-forming machine according to claim 7, further including respective hydraulic cylinders carried adapted to move the grippers or groups of the grippers relative to each other in order to form the opposite ends of the metal sheet into predetermined curved configurations.

11. The stretch-forming machine according to claim 7, further including at least one respective hydraulic cylinder carried by each yoke and adapted to urge each yoke along the beam way.

12. The stretch-forming machine according to claim 7, further including at least one respective hydraulic cylinder carried by each yoke and adapted to move each jaw relative to each respective yoke.

13. The method of stretch-forming a metal sheet comprising the steps of:

a)providing a stretch-forming machine of the type wherein a pair of opposed curving jaw assemblies grip opposite end edge portions of a metal sheet to be formed into a predetermined curved configuration, each jaw assembly including a jaw comprising an array of adjacent grippers moveable relative to each other to collectively define a part of the curve of the jaw and adapted to extend along one side edge of the metal sheet from adjacent a first corner to adjacent a second corner of the sheet, a moveable yoke connected to the jaw, a pivot assembly connecting the yoke to a beam way for pivoting the jaw about a laterally extending pivot axis defined by a contact point between the metal sheet and at least one centrally-positioned gripper, the contact point of the grippers being aligned with the laterally extending pivot axis within sheet-gripping openings defined by respective ones of the grippers such that the centrally-positioned gripper pivots about the contact point during pivotal movement of the centrally-positioned gripper thereby maintaining the contact point in about the same position during pivoting, and at least one actuator connected to the yoke for pivoting the jaw about the pivot axis;

b) stretching the metal sheet to a yield state by retracting the jaws rearwardly away from each other by movement of the pivot assembly respective to the beam way;

c) forming the metal sheet into a desired curvature over a die; and d) pivoting the jaws about the laterally extending pivot axis using the at least one actuator to urge the grippers at opposing ends of the gripper array away from the pivot axis in a stretching direction while the grippers adjacent a centerline of the gripper array remain approximately stationary, thereby further stretching outer edges of the metal sheet while substantially minimizing elongation along the centerline of the metal sheet.

14. The method of stretch-forming a metal sheet according to claim 13, further including the step of forming the metal sheet over a bulldozer assembly, the bulldozer assembly being moveable relative to the die.

15. The method of stretch-forming a metal sheet according to claim 13, further including the step of utilizing computer-controlled servo-feedback technology to define and control the shape of the metal sheet to be formed.

16. The method of stretch-forming a metal sheet according to claim 13, wherein the metal sheet is stretched to a yield state by urging the yokes away from each other along the beam way by at least one respective hydraulic cylinder carried by each yoke.

17. The method of stretch-forming a metal sheet according to claim 13, wherein the metal sheet is stretched to a yield state by retracting the jaws within their respective yokes by at least one respective hydraulic cylinder carried by each yoke.

* * * * *